US010325733B2

(12) United States Patent
Kim et al.

(10) Patent No.: US 10,325,733 B2
(45) Date of Patent: Jun. 18, 2019

(54) KEY BUTTON AND METHOD OF MANUFACTURING THE SAME

(71) Applicant: Samsung Electronics Co., Ltd., Gyeonggi-do (KR)

(72) Inventors: Byung-Sun Kim, Seoul (KR); Tae-Youl Kang, Gyeonggi-do (KR); Cheol-Hee Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 572 days.

(21) Appl. No.: 14/309,215

(22) Filed: Jun. 19, 2014

(65) Prior Publication Data

US 2015/0029645 A1 Jan. 29, 2015

(30) Foreign Application Priority Data

Jul. 26, 2013 (KR) ..... 10-2013-0088512

(51) Int. Cl.
*H01H 13/02* (2006.01)
*H01H 13/14* (2006.01)
*G05G 1/02* (2006.01)

(52) U.S. Cl.
CPC ..... *H01H 13/14* (2013.01); *G05G 1/02* (2013.01); *H01H 2217/004* (2013.01); *H01H 2223/04* (2013.01); *H01H 2229/00* (2013.01); *H01H 2229/066* (2013.01)

(58) Field of Classification Search
CPC .... G05G 1/02; H01H 13/14; H01H 2217/004; H01H 2223/04; H01H 2229/00; H01H 2229/066; H01H 13/02; H01H 9/0271
See application file for complete search history.

(56) References Cited

U.S. PATENT DOCUMENTS 3,863,040 A * 1/1975 Van Benschoten .... H01H 13/02 200/276
4,737,609 A * 4/1988 Yuhasz ..... H05B 39/086 174/16.3
5,545,865 A * 8/1996 Gotou ..... H01H 13/14 200/341
6,087,605 A * 7/2000 Heidenfels ..... H01H 13/14 200/341
6,107,585 A * 8/2000 Gehr ..... H01H 3/122 200/341
2004/0182687 A1* 9/2004 Tsubaki ..... H01H 3/12 200/341

(Continued)

FOREIGN PATENT DOCUMENTS

KR 1020060007702 1/2006
KR 1020080063640 7/2008

*Primary Examiner* — Hoa C Nguyen
*Assistant Examiner* — Christopher L Augustin
(74) *Attorney, Agent, or Firm* — The Farrell Law Firm, P.C.

(57) ABSTRACT

A key button and a method of manufacturing the same are provided. The key button includes an upper surface, a side surface formed at a certain height along a border of the upper surface, and at least two worked surfaces formed to have a certain slope in a boundary portion between the side surface and the upper surface, wherein at least one first worked surface and at least one second worked surface are formed such that a shortest distance between the upper surface and the side surface differs from each other.

11 Claims, 10 Drawing Sheets

(56) References Cited

U.S. PATENT DOCUMENTS

| | | | | |
|---|---|---|---|---|
| 2005/0133355 | A1* | 6/2005 | Shimoda | H01H 13/14 200/341 |
| 2005/0189205 | A1* | 9/2005 | Fujii | H01H 9/182 200/314 |
| 2005/0224329 | A1* | 10/2005 | Milo | E05B 17/22 200/341 |
| 2006/0131149 | A1* | 6/2006 | Mattarelli | H01H 13/04 200/329 |
| 2008/0075516 | A1* | 3/2008 | Hou | H01H 3/125 400/477 |
| 2008/0230360 | A1* | 9/2008 | Wada | H01H 23/30 200/339 |
| 2009/0107821 | A1* | 4/2009 | Ono | H01H 13/14 200/341 |
| 2009/0268382 | A1* | 10/2009 | Zhao | H01H 13/14 361/679.01 |
| 2009/0301852 | A1* | 12/2009 | Keist | B60K 37/06 200/341 |
| 2010/0224470 | A1* | 9/2010 | Naas | G05G 1/02 200/330 |
| 2012/0298493 | A1* | 11/2012 | Hogan | G05G 1/02 200/314 |
| 2013/0213781 | A1* | 8/2013 | Lee | H01H 13/14 200/320 |
| 2013/0292235 | A1* | 11/2013 | Baum | H01H 13/06 200/302.2 |
| 2014/0048400 | A1* | 2/2014 | Malek | H01H 13/06 200/517 |

* cited by examiner

KEY BUTTON AND METHOD OF MANUFACTURING THE SAME

PRIORITY

This application claims priority under 35 U.S.C. § 119(a) to a Korean Patent Application filed in the Korean Intellectual Property Office on Jul. 26, 2013 and assigned Serial No. 10-2013-0088512, the entire disclosure of which is incorporated herein by reference.

BACKGROUND OF THE INVENTION

1. Field of the Disclosure

The present disclosure generally relates to a key button, and more particularly, to a key button and a method of manufacturing the same.

2. Description of the Related Art

Recently, a touch screen device, for simultaneously performing input and output, has been used as a data input and output means in an electronic device. The touch screen device may display an input button of a switch type on its display screen. If a user touches a displayed switch, the touch screen device receives corresponding data.

In addition to the above-described data input means of a software type, the electronic device may perform functions, such as a function for providing a sense of touch to the user, a power on/off function, a function for performing conversion to its wake-up mode or its sleep mode, a function for adjusting volume, a function for quickly jumping from a current page to a predetermined basic page, etc. In order to perform these functions, the electronic device may have at least one physical key button to be operated by the user.

A part of this physical key button, for example, a part of a key top, is installed in a key hole formed in a case frame of the electronic device to protrude from the case frame. The key button is a mechanical type key for pressing a switching means installed in the electronic device by an actuator which protrudes in a direction from the key top to an internal side of the electronic device.

This switching means electrically connects with a circuit board installed in the electronic device. The switching means is disposed in a pressing range of the above-described actuator and performs a switching operation selectively by a pressing operation of the actuator. Accordingly, a metal dome, for selectively connecting carbon contacts, is mainly used as the switching means. This metal dome provides a sense of a click to the user as well as a switching function when being pressed by the actuator.

The key button used in this physical key button device is installed such that at least a part of it protrudes from the case frame of the electronic device. A soft touch of the protruding key button as well as excellent aesthetics is important to the marketability and competitiveness of the electronic device.

Therefore, it is considerably important to design the key button to have the excellent aesthetic value as well as a soft touch in the electronic device.

SUMMARY OF THE INVENTION

An aspect of the present disclosure is to solve at least the above-mentioned problems and/or disadvantages and to provide at least the advantages described below. Accordingly, an aspect of the present disclosure is to provide a key button and a method of manufacturing the same.

Another aspect of the present disclosure is to provide a key button having an excellent aesthetic value and a soft touch and a method of manufacturing the same.

Another aspect of the present disclosure is to provide a key button having an excellent aesthetic value and a soft touch while keeping a conventional working method and a method of manufacturing the same.

Another aspect of the present disclosure is to provide a key button having an excellent aesthetic value and a soft touch without a separate additional working procedure and a method of manufacturing the same.

In accordance with an aspect of the present disclosure, a key button is provided. The key button includes an upper surface, a side surface formed at a certain height along a border of the upper surface, and at least two worked surfaces formed to have a certain slope in a boundary portion between the side surface and the upper surface, wherein at least one first worked surface and at least one second worked surface are formed such that a shortest distance between the upper surface and the side surface differs from each other.

In accordance with another aspect of the present disclosure, an electronic device is provided. The electronic device includes a case frame and at least one key button installed in the case frame such that a part thereof is exposed at a portion of the case frame, wherein at least the one key button includes an upper surface, a side surface formed at a certain height along a border of the upper surface, and at least two worked surfaces formed to have a certain slope in a boundary portion between the side surface and the upper surface, and wherein at least one first worked surface and at least one second worked surface are formed such that a shortest distance between the upper surface and the side surface differs from each other.

In accordance with another aspect of the present disclosure, a method of manufacturing a key button is provided. The method includes preparing a basic material including an upper surface, and a side surface formed at a certain height along a border of the upper surface, forming at least two worked surfaces by working the key button using a working tool to have a certain slope along a boundary portion between the side surface and the upper surface of the prepared basic material, and adjusting an amount of offset of the working tool such that a shortest distance between the upper surface and the side surface of at least one first worked surface and at least one second worked surface while forming at least the two worked surfaces are different from each other.

In accordance with another aspect of the present disclosure, an electronic device is provided. The electronic device includes a case frame and a longitudinal key button installed in the case frame such that a part thereof is exposed at a portion of the case frame, wherein the longitudinal key button includes an upper surface, a side surface formed at a certain height along a border of the upper surface, a pair of first worked surfaces formed between the side surface and the upper surface to have a certain slope in positions which are opposite to each other in a longitudinal direction of the longitudinal key button, and a pair of second worked surfaces formed between the side surface and the upper surface to have a certain slope in positions which are opposite to each other in a width direction of the longitudinal key button, and wherein a shortest distance between the upper surface and the side surface of the pair of first worked surfaces is formed to be greater than that of a shortest distance of the pair of second worked surfaces.

BRIEF DESCRIPTION OF THE DRAWINGS

The above and other aspects, features and advantages of certain embodiments of the present disclosure will be more apparent from the following detailed description taken in conjunction with the accompanying drawings, in which.

DETAILED DESCRIPTION OF EMBODIMENTS OF THE PRESENT INVENTION

Embodiments of the present disclosure will be described herein below with reference to the accompanying drawings. In the following description, well-known functions or constructions are not described in detail since they would obscure the disclosure in unnecessary detail.

In explaining various embodiments of the present disclosure, a description will be given for an electronic device, including a touch screen device, in which a key button is installed to be exposed to the outside at a certain place of its external surface. However, the electronic device may be, but is not limited to, any electronic device, such as a Personal Digital Assistant (PDA), a laptop computer, a mobile phone, a smart phone, a netbook, a Mobile Internet Device (MID), a Ultra Mobile Personal Computer (UMPC), a tablet PC, a navigation device, a Moving Picture Experts Group (MPEG) layer 3 (MP3) player, and the like, each including at least one key button whose part as a data input means is installed in a case frame to protrude from the case frame.

In explaining various embodiments of the present disclosure, the electronic device may also include a general device in addition to the key button used as the data input means. Also, the electronic device may have a structure of a key button shape which is not a data input means and is installed to protrude to the outside.

Figure 1:
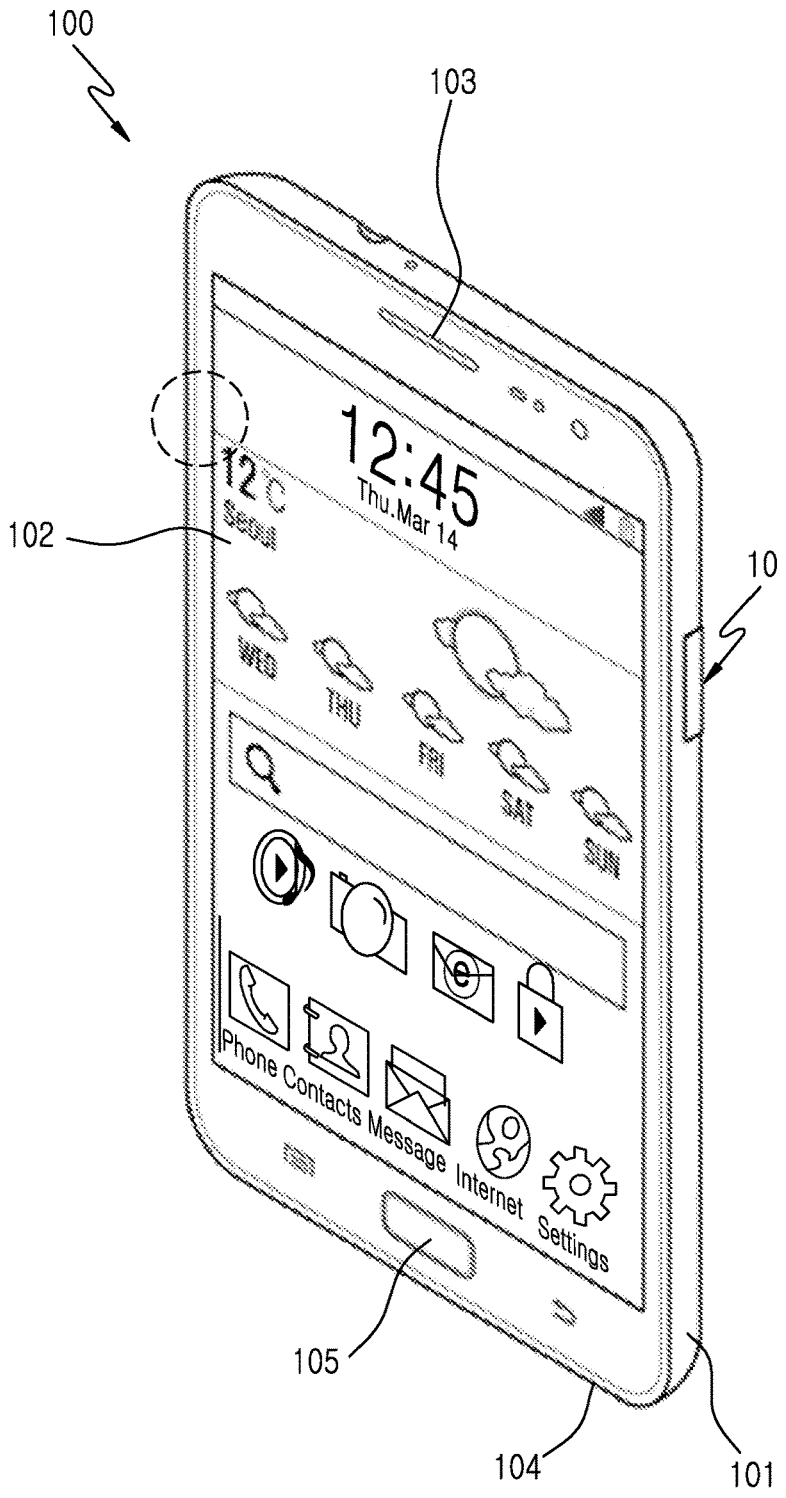
FIG. 1 is a perspective view of an electronic device having a key button according to an embodiment of the present disclosure.

FIG. 1 is a perspective view of an electronic device for providing a key button according to an embodiment of the present disclosure.

Referring to FIG. 1, the electronic device 100 has a case frame 101 which forms its appearance. A display module 102 is installed on a front surface of the electronic device 100. The display module 102 may be a touch screen device, in which a touch panel and a Liquid Crystal Display (LCD) module are installed together, for simultaneously performing data input and output. A speaker device 103 may be installed on the display module 102. A microphone device 104 may be installed at a lower side of the display module 102.

In accordance with an embodiment of the present disclosure, a key button 10 may be installed at a side surface of the case frame 101 of the electronic device 100. The key button 10 is installed such that a part is exposed to the outside and protrudes from the case frame 101. The key button 10 may be used, for example, as a volume key button of the electronic device 100, or as a key button for mode conversion for performing conversion to a sleep mode or a wake-up mode of the electronic device 100. The key button 10 may also be applied to a home button 105 disposed in a front surface of the electronic device 100, or may be disposed in various regions of the electronic device, such as shown by a circular dotted line in FIG. 1.

In accordance with one embodiment of the present disclosure, although a part of this key button 10 is exposed to the outside of the electronic device 100, the key button 10 is configured not only to have an excellent aesthetic value, but also to prevent the user from feeling any sharpness to this end when touching the key button 10. A corner of the key button 10 (including a side surface) does not protrude in principle from the case frame 101. During manufacture, the corners of the key button 10 protrude equally from the case frame 101, and an amount of offset by a working tool is increased to reduce an amount of protrusion of a narrow width interval of the corners and side surfaces of the key button 10.

Hereinafter, a description will be given for a method of shaping and working the key button 10 according to an embodiment of the present disclosure.

Figure 2:
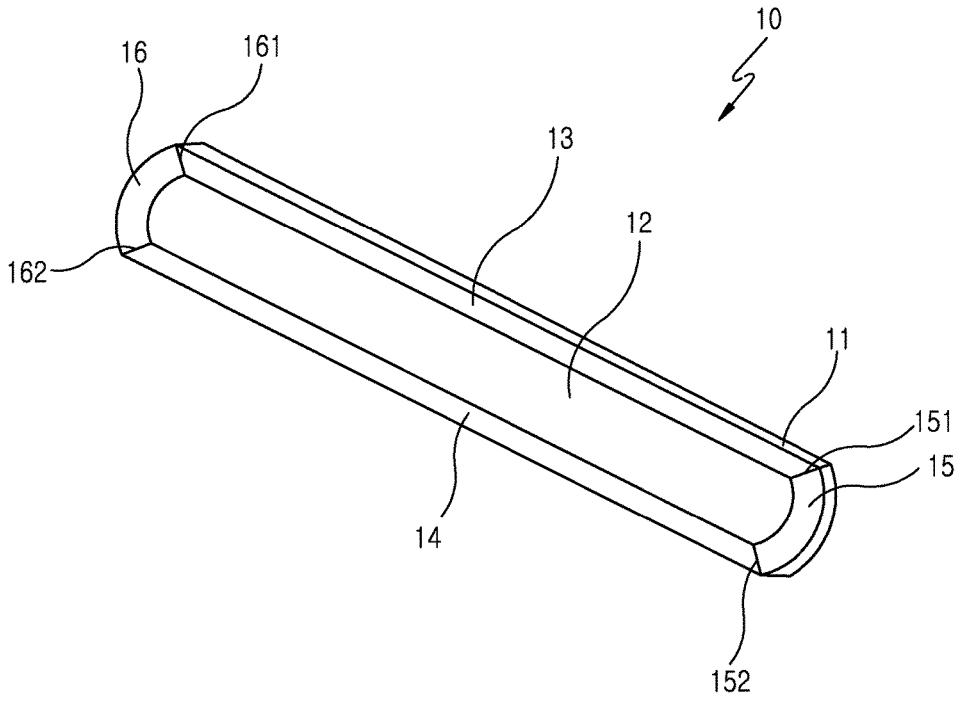
FIG. 2 is a detailed perspective view of a key button according to an embodiment of the present disclosure.

FIG. 2 is a detailed perspective view of a key button according to one embodiment of the present disclosure.

Referring to FIGS. 1 and 2, the key button 10 includes an upper surface 12 having a certain size and a side surface 11 formed to provide a certain height along a border of the upper surface 12. Worked surfaces 13 to 16, each of them having a certain slope, are beveled to remove sharpness of the corner portions where the upper surface 12 contacts with the side surface 11.

In an embodiment of the present disclosure, the key button 10 has a certain length. The worked surfaces 13 to 16 include the first worked surface 13 formed in a longitudinal direction of the key button 10 and the second worked surface 14 formed opposite to the first working surface 13. The worked surfaces 13 to 16 include the third worked surface 15 and the fourth worked surface 16 which are formed in a width direction at opposite ends of the key button 10. A worked surface with which the side surface 11 and the upper surface 12 of the key button 10 come in contact is formed to have a closed curve for closing the upper surface 12 by continuously forming the first closed surface 13, the second closed surface 14, the third closed surface 15, and the fourth worked surface 16. The third worked surface 15 and the fourth worked surface 16 which are formed in the width direction of the key button 10 are formed as a shape curved in a direction to the outside. Accordingly, a width portion of the upper surface 12 and a width portion of the side surface 11 which are extended from the third worked surface 15 and the fourth worked surface 16 have a natural curved shape.

In one embodiment of the present disclosure, the key button 10 includes a first portion 151 which is a point ending in a direction to one end of the first worked surface 13 where the curve shape of the third worked surface 15 starts. The key button also includes a second portion 152 which is a point where the curved shape of the third worked surface 15 ends and the second worked surface 14 starts. The key button 10 also includes a third portion 161 which is a point ending in a direction at the other end of the first worked surface 13, in which the curved shape of the fourth worked surface 16 starts, and a fourth portion 162 which is a point in which the curved shape of the fourth worked surface 16 ends and the second worked surface 14 starts.

In the embodiment of the present disclosure, a portion curved in a width direction of the key button 10 provides a relatively sharp sense of touch to a user in comparison with a longitudinal direction of the key button 10. The bigger a portion exposed from the case frame 101 among side surfaces of the key button 10 is, the greater a relative sharp sense of touch is provided to the user.

In the embodiment of the present disclosure, a portion having a relatively narrow width of the key button 10 (or a side portion having a greater amount of exposure from the case frame 101) is formed as a worked surface having a shortest distance. The shortest distance has a worked surface which is longer than those of other worked surfaces by increasing an amount of offset in a direction to the inside of a closed curve formed by the worked surfaces and working the portion when processing the portion using a working tool.

The "shortest distance" means the shortest distance of the worked surface between the upper surface 12 and the side surface 11 of the key button 10.

During forming of the worked surfaces, although an amount of offset of the working tool may change, because the key button 10 is moved in only a horizontal direction (x direction), the shortest distance of the worked surface may change but a slope does not changed.

The third worked surface 15 and the fourth worked surface 16 which have a relative narrow width have a greater shortest distance than the shortest distance of the first worked surface 13 and the second worked surface 14 by increasing an amount of offset by the working tool. A portion where an amount of offset of the key button 10 is increased may remove sharpness felt by the user because an exposed portion of the side surface 11 of the key button 10 installed in the case frame 101 is reduced.

In an embodiment of the present disclosure, the key button 10 is formed of metal materials. In this case, worked surfaces are formed using a separate working tool. A description will be given for a working method using the working tool below.

In an embodiment of the present disclosure, the key button 10 is formed of plastic materials. In this case, the key button 10 is formed by an injection method using a metal die which is formed where an amount of offset of a worked surface in which the side surface 11 of the key button 10 has a greater exposure from the case frame 101, and/the worked surface has a relatively narrow width.

In another embodiment of the present disclosure, the key button 10 may also be formed of glass materials.

Figure 3:
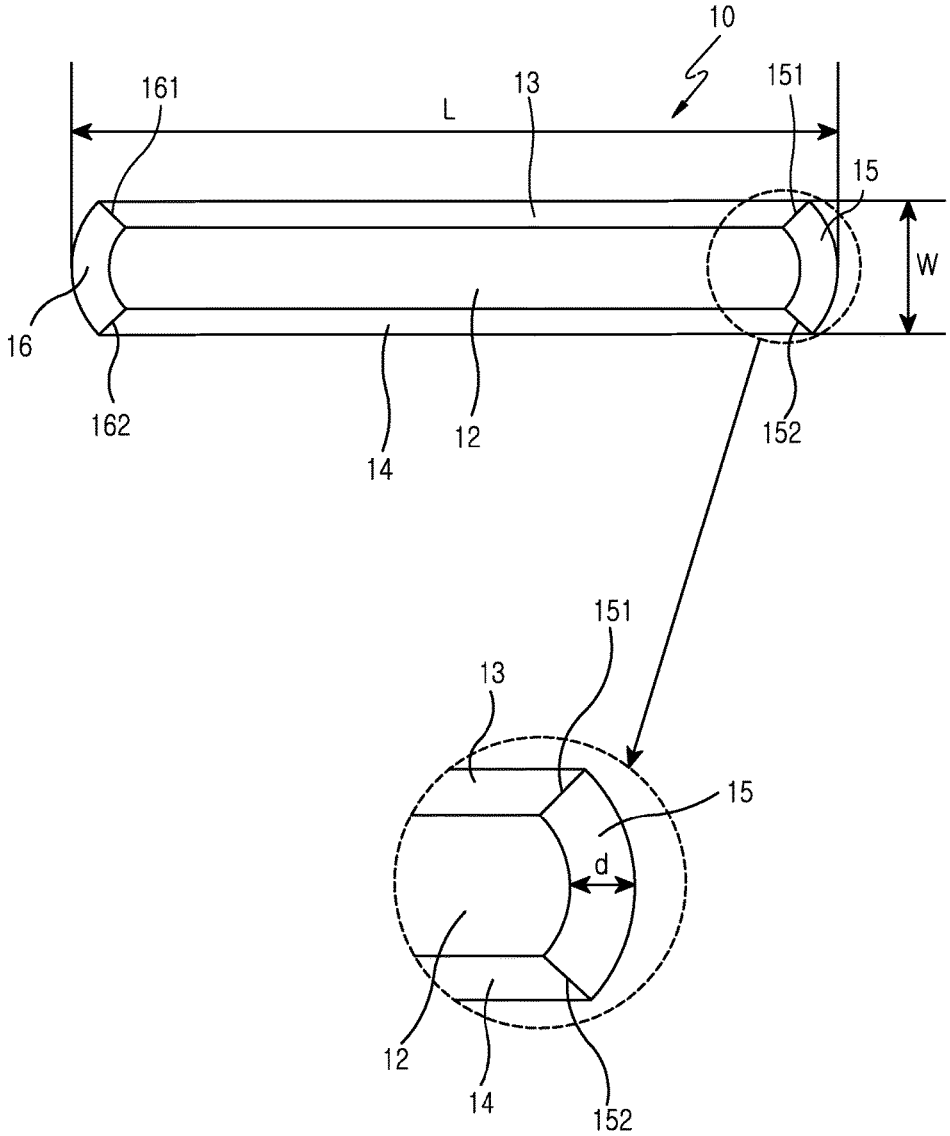
FIG. 3 is a plan view of a key button according to an embodiment of the present disclosure.

FIG. 3 is a plan view of a key button according to an embodiment of the present disclosure.

Referring to FIGS. 2 and 3, the first to fourth worked surfaces 13 to 16 for connecting a longitudinal direction L with a width direction W of the key button 10 are formed. The first worked surface 13 and the second worked surface 14 are formed in the longitudinal direction (L direction). The third worked surface 15 and the fourth worked surface 16 are formed in the width direction (W direction). The first worked surface 13, the second worked surface 14, the third worked surface 15, and the fourth worked surface 16 connect to each other and form a closed curve. In this case, the third worked surface 15 and the fourth worked surface 16 which have a relatively narrow width and are formed as a curved shape towards the outside are formed so that the shortest distance d is increased. A feeling of sharpness may be removed by increasing this shortest distance. A degree of exposure of the side surface 11 may be reduced from the case frame 101.

In accordance with one embodiment of the present disclosure, the third worked surface 15 is formed by increasing an amount of offset by a working tool, and may be defined as a portion which is converted from the longitudinal direction to the width direction of the key button 10. That is, the third worked surface 15 is defined from the first portion 151, which is here the first worked surface 13 transitions to the third worked surface 15, to the second portion 152 which is where the third worked surface 15 transitions to the second worked surface 14. The fourth worked surface 16 is also formed by increasing an amount of offset by the working tool, and may be also defined as a portion which is converted from the longitudinal direction to the width direction of the key button 10. That is, the fourth worked surface 16 is defined from the third portion 161, which is where the first worked surface 13 transitions to the fourth worked surface 16, to the fourth portion 162 which is where the fourth worked surface 16 transitions to the second worked surface 14.

In accordance with an embodiment of the present disclosure, the third worked surface 15, from the first portion 151 to the second portion 152, is worked by an amount of offset which is greater than that of the first worked surface 13, and has an equal shortest distance along its entire surface. The third worked surface 15 alternatively may also have the shortest distance which is worked by a variable amount of offset, such as being gradually increased, gradually decreased, or gradually decreased after being gradually increased.

The fourth worked surface 16, from the third portion 161 to the fourth portion 162, also has an amount of offset which is greater than that of the first worked surface 13, and has an equal shortest distance worked along its entire surface. The fourth worked surface 16 alternatively may also have the shortest distance which is worked by a variable amount of offset, such as being gradually increased, gradually decreased, or gradually decreased after being gradually increased.

In accordance with one embodiment of the present disclosure, the shortest distance formed according to an increased amount of offset may be formed to be symmetric or asymmetric in a horizontal or vertical direction.

Figure 4A:
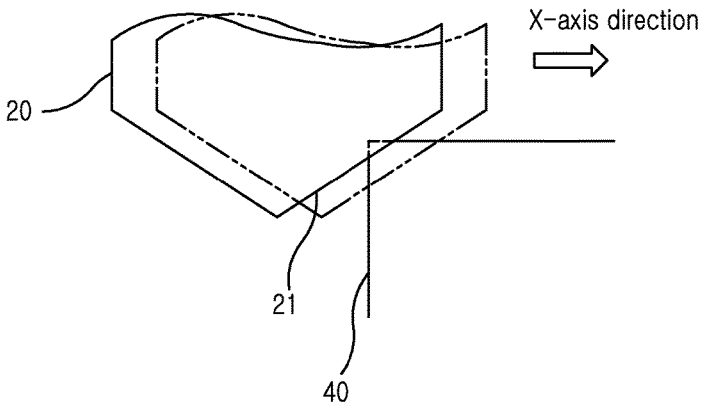
FIGS. 4A and 4B illustrate a method of working a basic material by a tool according to another embodiment of the present disclosure.
Figure 4B:
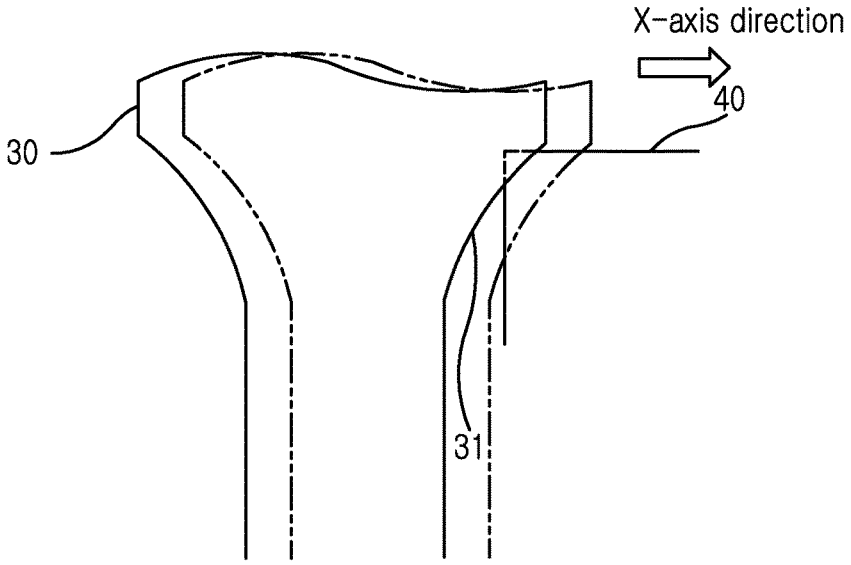

FIGS. 4A and 4B illustrate a method of working a basic material by a working tool according to an embodiment of the present disclosure.

Referring to FIG. 4A, a contact surface 21 of a working tool 20 for cutting a basic material 40 may be implemented as a straight line type. In accordance with an embodiment of the present disclosure, the basic material 40 may be a metal or glass material and may include an upper surface and a side surface which has a certain height along a border of the upper surface. A portion with which the upper surface and the side surface come in contact may be implemented as a sharp corner shape. The contact surface 21 of the working tool 20 comes in contact with this corner to form the above-described worked surface.

In accordance with an embodiment of the present disclosure, the working tool 20 may be moved in only a horizontal direction (X-axis direction), without being moved in a vertical direction. An additional process for moving a working tool in a Z-axis may be implemented using a separate working device for separate three-dimensional working. However, a key button in which an amount of offset is increased in a corresponding worked surface, to be identical to a three-dimensional working method, may be obtained by the present disclosure as the working tool 20 is moved in an X-axis direction.

Referring to FIG. 4B, a contact surface 31 of a working tool 30 for cutting a basic material 40 may be implemented as a curve shape. In this case, also, the working tool 30 is moved in only an X-axis direction. A key button may be worked by increasing an amount of offset in a corresponding worked surface of the key button.

In accordance with one embodiment of the present disclosure, when a contact surface of the working tool 20 is a straight line, a worked surface of a key button may be formed as a plane. When a contact surface of the working tool 30 is a curved shape curved in the center direction of the working tool 30, a worked surface of a key button may be formed as a curved surface which protrudes upwardly.

FIGS. 5 to 9 illustrate a worked key button applied to a case frame according to various embodiments of the present disclosure.

Figure 5:
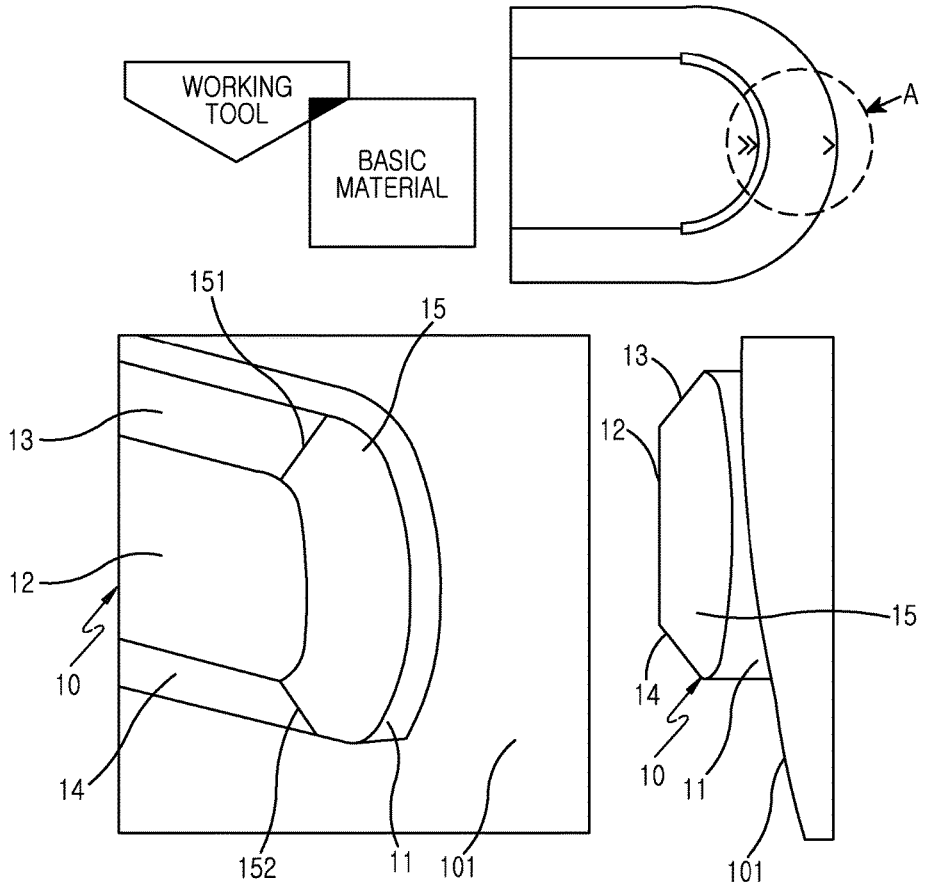
FIG. 5 illustrates a worked key button applied to a case frame according to an embodiment of the present disclosure.

Referring to FIGS. 2 and 5, the key button 10 is worked by increasing an amount of offset of a working tool from the first portion 151 to the second portion 152, thus increasing the shortest distance. In accordance with one embodiment of the present disclosure, a contact surface of the working tool is formed as a straight line. Accordingly, the third worked surface 15 is formed as a plane. When this key button 10 is mounted on the case frame 101, it may be formed to have the same shortest distance from the first portion 151 to the second portion 152 of the third worked surface 15 irrespective of an amount of exposure of the side surface 11 of the key button 10, which is exposed from the case frame 101. The key button 10 has the same shortest distance from the first portion 151 to the second portion 152 through a portion denoted by dotted circle A. In this case, there is no difference in the shortest distance, although a degree in which the side surface 11 of the key button 10 is exposed from the case frame 101 differs.

Figure 6:
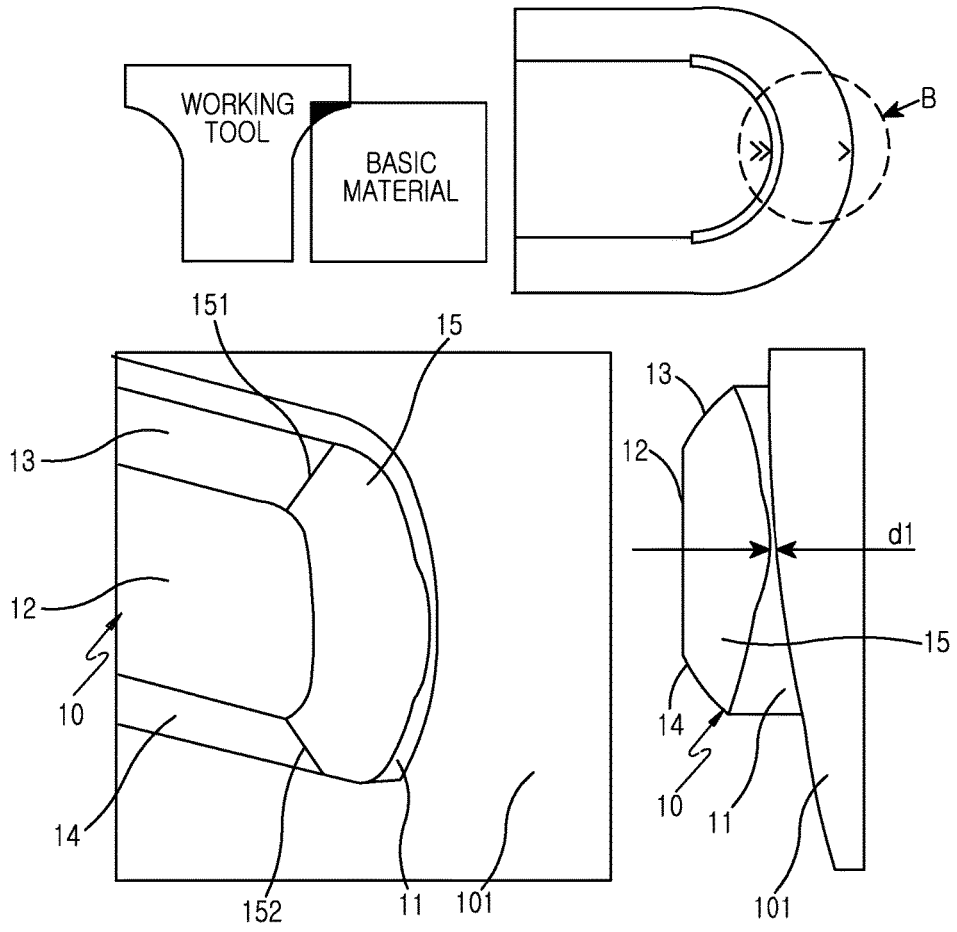
FIG. 6 illustrates a worked key button applied to a case frame according to another embodiment of the present disclosure.

Referring to FIGS. 2 and 6, the key button 10 is worked by increasing an amount of offset of a working tool from the first portion 151 to the second portion 152 of the third worked surface 15, thus increasing the shortest distance. In accordance with one embodiment of the present disclosure, a contact surface of the working tool is formed as a curved shape. Accordingly, the third worked surface 15 is formed to have a curved surface which protrudes upwardly. An amount of offset of the working tool is increased more in a portion denoted by dotted circle B portion and the key button 10 is worked while increasing an amount of offset of the working tool and working the key button 10. An exposure distance d1 of the portion B which is at the center portion of the side surface 11 of the key button 10 is less than a corresponding portion of FIG. 5 from the case frame 101. A sharp sense of touch may be removed by minimizing this exposure of the side surface 11 of the key button 10.

Figure 7:
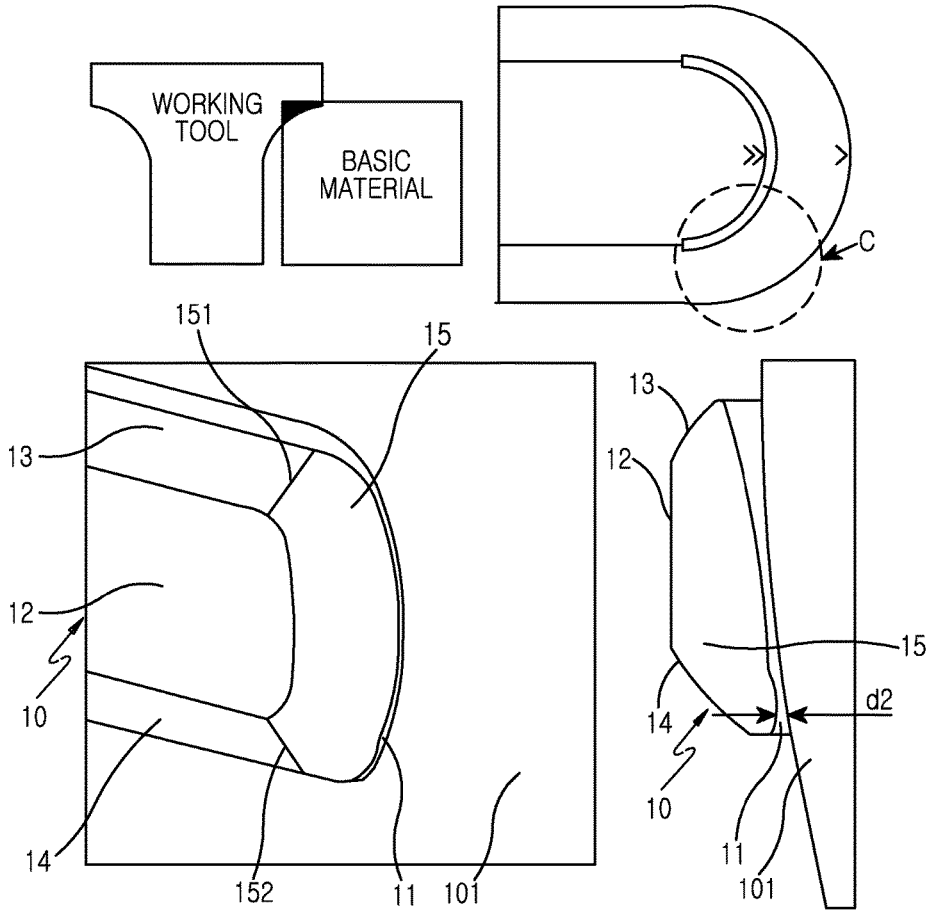
FIG. 7 illustrates a worked key button applied to a case frame according to another embodiment of the present disclosure.

Referring to FIGS. 2 and 7, the key button 10 is worked by increasing an amount of offset of a working tool from the first portion 151 to the second portion 152 of the third worked surface 15, thus increasing the shortest distance. In accordance with one embodiment of the present disclosure, a contact surface of the working tool is formed as a curved shape. Accordingly, the third worked surface 15 is formed to have a curved surface which protrudes upwardly. The shortest distance of the third worked surface 15 is changed by asymmetrically adjusting an amount of offset of the working tool to be different from the above-described embodiments. The shortest distance is increased by increasing an amount of offset of the working tool for a portion denoted by the dotted circle C of FIG. 7, which is a side portion and the most exposed portion from the case frame 101 of the key button 10. Accordingly, as shown in FIG. 7, the side surface 11 of the portion C of the key button 10 is relatively less exposed at distance d2 than a corresponding portion of FIG. 6 from the case frame 101.

Figure 8:
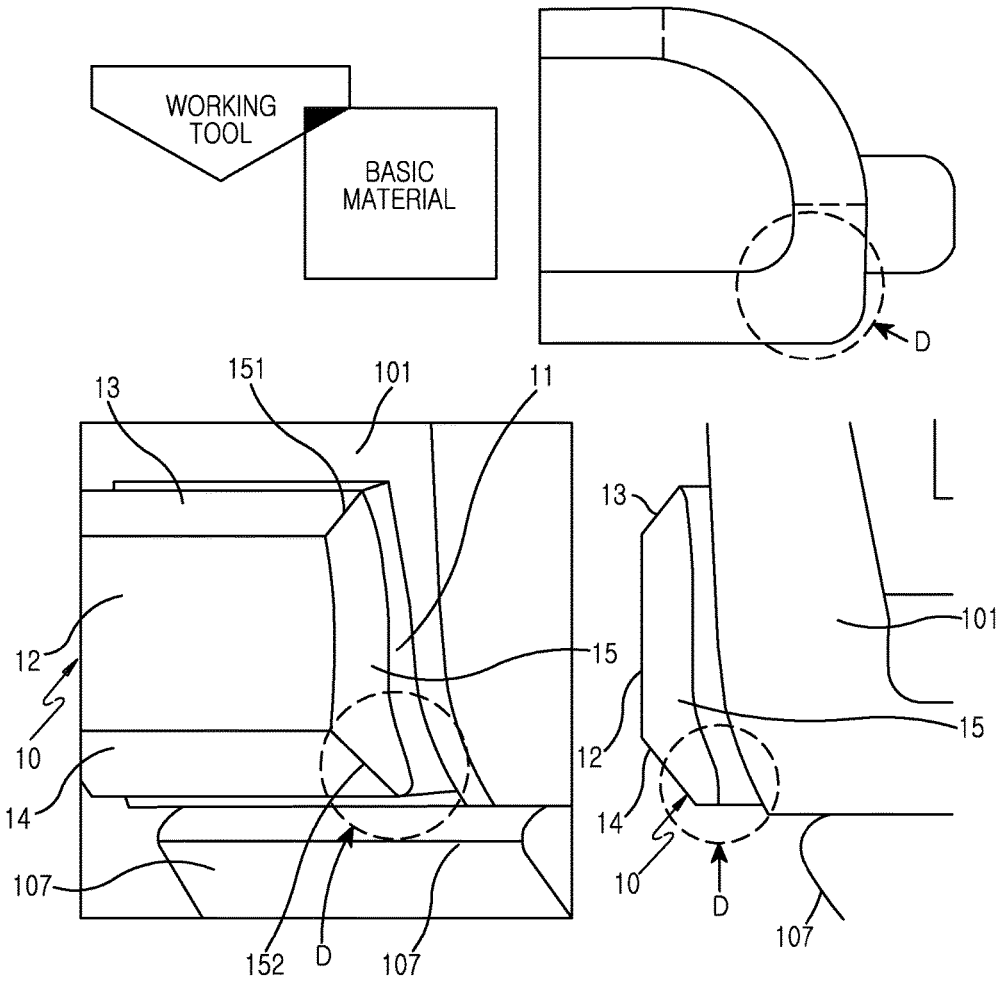
FIG. 8 illustrates a worked key button applied to a case frame according to another embodiment of the present disclosure.

Referring to FIGS. 2 and 8, the key button 10 is installed in a boundary portion between two case frames 101 and 107. In this case, because a portion denoted by the dotted circle D, which is the boundary portion between the two case frames 101 and 107 among side surfaces of the key button 10, is relatively more exposed, a feeling of sharpness may be felt by a user. Accordingly, when working the key button 10 using a working tool with a straight line, the shortest distance may be increased by increasing an amount of offset in the portion D. Therefore, the side surface 11 of the key button 10 worked by increasing an amount of offset in the D portion D is relatively less exposed than a corresponding portion of the key button 10 when working the key button 10 by a same amount of offset. For this reason, a soft sense of touch is provided by the user in the corresponding portion.

Figure 9:
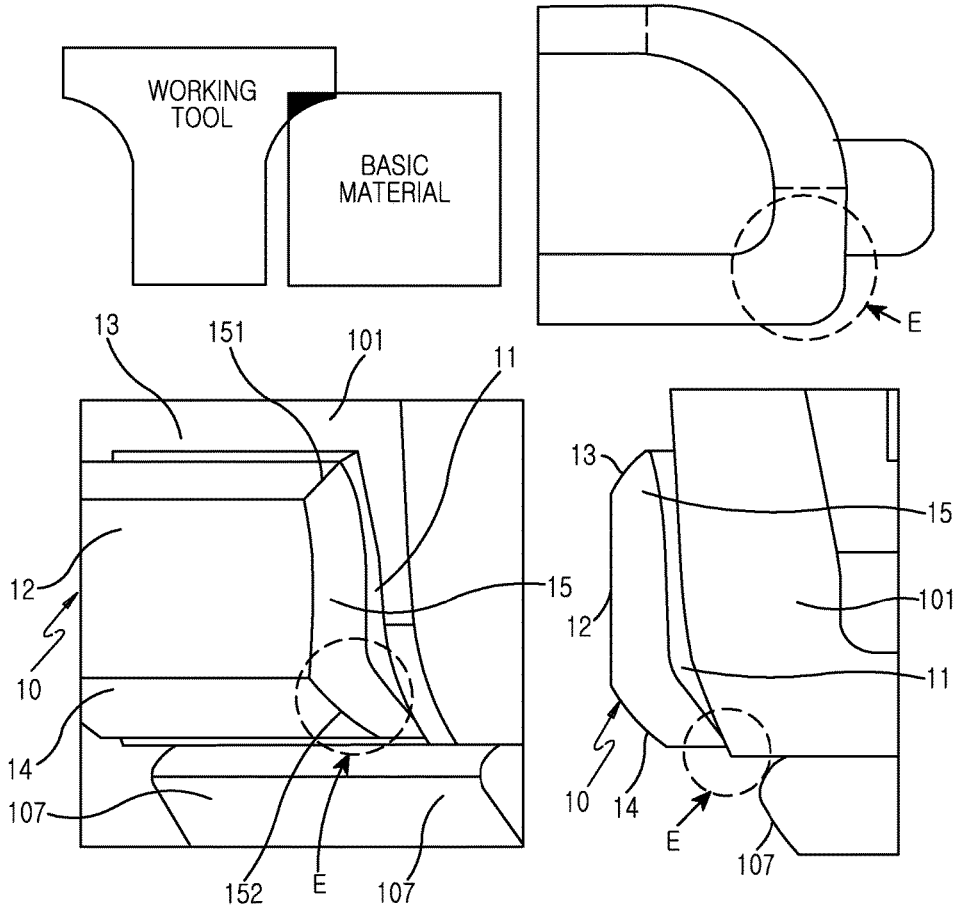
FIG. 9 illustrates a worked key button applied to a case frame according to another embodiment of the present disclosure.

Referring to FIGS. 2 and 9, the key button 10 is installed in a boundary portion between two case frames 101 and 107. In this case, because a portion denoted by the dotted circle E, which is the boundary portion between the two case frames 101 and 107 among side surfaces of the key button 10, is relatively more exposed, a feeling of sharpness may be felt by a user. Accordingly, when working the key button 10 using a working tool, the shortest distance may be increased by increasing an amount of offset in the portion E. A contact surface of the working tool is formed as a curved shape in FIG. 9 in comparison with the contact surface of the working tool having a straight line in FIG. 8. Accordingly, in common with FIG. 8, although a same amount of offset by the working tool is applied to the portion E, the side surface 11 of the key button 10 is formed so as to not be more exposed than a corresponding portion of FIG. 8.

In accordance with various embodiments of the present disclosure, an amount of offset by the working tool may be changed according to a degree in which the side surface (corner) of the key button protrudes from the case frame. An amount of offset by the working tool may be increased in a portion which has a greater amount of protrusion in which the side surface of the key button protrudes from the case frame.

In accordance with various embodiments of the present disclosure, when the side surface (corner) of the key button has a same amount of offset, an amount of offset of an interval having a narrow external shape of the key button may be increased.

In accordance with various embodiments of the present disclosure, the electronic device provides an excellent aesthetic value and a soft touch to the user by removing a protruding sharp portion of the key button without a separate additional procedure.

While the present disclosure has been particularly shown and described with reference to certain embodiments thereof, it will be understood by those skilled in the art that various changes in form and details may be made therein without departing from the spirit and scope of the present disclosure as defined by the appended claims.

What is claimed is:

1. A key button, comprising:

an upper surface;

a side surface formed along a border of the upper surface, the side surface including:

a first side surface portion and a second side surface portion facing each other in a first direction and having a same first length, and a third side surface portion and a fourth side surface portion facing each other in a second direction perpendicular to the first direction and having a same second length, which is shorter than the first length; and at least two worked surfaces formed to have a certain slope along a boundary portion between the side surface and the upper surface, the at least two worked surfaces including:

a first worked surface and a second worked surface corresponding to the first side surface portion and the second side surface portion, respectively, and having a same first interval between the upper surface and the first side surface or the second side surface with a first distance, and a third worked surface and a fourth worked surface corresponding to the third side surface portion and the fourth side surface portion, respectively, and having a second interval between the upper surface and the third side surface or fourth side surface, wherein a shortest second distance among the second interval is formed to be greater than the first distance, wherein at least a portion of the third worked surface and the fourth worked surface includes a third distance formed to be greater than the shortest second distance, and wherein the portion of the third side surface portion and the fourth side surface portion corresponding to the at least a portion of the third worked surface and the fourth worked surface is relatively less exposed from a case frame of an electronic device to remove a feeling of sharpness in a portion of the key button having a relatively shorter length.

2. The key button of claim 1, wherein the third worked surface and the fourth worked surface are formed in a most exposed portion of the side surface of the key button from the case frame of the electronic device.

3. The key button of claim 1, wherein the third worked surface and the fourth worked surface are formed in a narrowest interval on the appearance of the key button.

4. The key button of claim 1, wherein the third worked surface and the fourth worked surface are formed as a plane or a curved surface which protrudes upwardly.

5. The key button of claim 1, wherein the key button is formed of metal materials, glass materials, or plastic materials.

6. The key button of claim 1, wherein the key button is installed such that at least a part of the upper surface and the side surface is exposed from the case frame of the electronic device.

7. An electronic device comprising:

a case frame; and at least one key button installed in the case frame such that a part thereof is exposed at a portion of the case frame, wherein at least the one key button includes: an upper surface;

a side surface formed along a border of the upper surface, the side surface including:

a first side surface portion and a second side surface portion facing each other in a first direction and having a same first length, and a third side surface portion and a fourth side surface portion facing each other in a second direction perpendicular to the first direction and having a same second length, which is shorter than the first length; and at least two worked surfaces formed to have a certain slope along a boundary portion between the side surface and the upper surface, the at least two worked surfaces including:

a first worked surface and a second worked surface corresponding to the first side surface portion and the second side surface portion, respectively, and having a same first interval between the upper surface and the first side surface or the second side surface with a first distance, and a third worked surface and a fourth worked surface corresponding to the third side surface portion and the fourth side surface portion, respectively, and having a second interval between the upper surface and the third side surface or the fourth side surface, wherein a shortest second distance among the second interval is formed to be greater than the first distance, wherein at least a portion of the third worked surface and the fourth worked surface includes a third distance formed to be greater than the shortest second distance, and wherein the portion of the third side surface portion and the fourth side surface portion corresponding to the at least a portion of the third worked surface and the fourth worked surface is relatively less exposed from the case frame of the electronic device to remove a feeling of sharpness in a portion of the key button having a relatively shorter length.

8. The electronic device of claim 7, wherein the shortest second distance is formed on a start portion of the third worked surface and the fourth worked surface, respectively, or an end portion of the third worked surface and the fourth worked surface, respectively.

9. The electronic device of claim 7, wherein the third worked surface and the fourth worked surface are formed in a most exposed portion of the side surface of the key button from the case frame.

10. The electronic device of claim 7, wherein the third worked surface and the fourth worked surface are formed in a narrowest interval on the appearance of the key button.

11. The electronic device of claim 7, wherein the third worked surface and the fourth worked surface are formed as a plane or a curved surface which protrudes upwardly.

* * * * *